US008641228B1

(12) United States Patent
Drake et al.

(10) Patent No.: US 8,641,228 B1
(45) Date of Patent: Feb. 4, 2014

(54) TRACK-MOUNTED DECORATIVE LIGHTING APPARATUS

(76) Inventors: Dale R. Drake, San Bernardino, CA (US); Raymond Drake, III, Santa Clarita, CA (US)

( * ) Notice: Subject to any disclaimer, the term of this patent is extended or adjusted under 35 U.S.C. 154(b) by 170 days.

(21) Appl. No.: 13/367,652

(22) Filed: Feb. 7, 2012

(51) Int. Cl.
*F21S 4/00* (2006.01)

(52) U.S. Cl.
USPC ..... 362/217.14; 362/217.16; 362/386; 362/272; 362/233; 362/286; 362/387

(58) Field of Classification Search
USPC ..... 362/386, 382, 383, 423, 272, 275, 286, 362/287, 387, 233; 340/825.21, 825.22
See application file for complete search history.

(56) References Cited

U.S. PATENT DOCUMENTS

| | | | | |
|---|---|---|---|---|
| 4,731,710 | A | 3/1988 | Distasio | |
| 5,067,061 | A | 11/1991 | Prickett | |
| 5,072,216 | A * | 12/1991 | Grange | 362/233 |
| 5,154,509 | A | 10/1992 | Wulfman et al. | |
| 6,050,709 | A | 4/2000 | Hastings | |
| 6,183,104 | B1 | 2/2001 | Ferrara | |
| 6,364,508 | B1 | 4/2002 | Moreland | |
| 6,655,817 | B2 * | 12/2003 | Devlin et al. | 362/233 |
| 7,159,998 | B2 | 1/2007 | Moreland | |
| 7,244,039 | B1 | 7/2007 | Emmons et al. | |
| 7,507,005 | B1 * | 3/2009 | Mier-Langner | 362/418 |
| 2003/0107888 | A1 * | 6/2003 | Devlin et al. | 362/233 |
| 2005/0231134 | A1 * | 10/2005 | Sid | 315/294 |
| 2007/0211453 | A1 | 9/2007 | Hamburger | |
| 2007/0268701 | A1 * | 11/2007 | Devlin | 362/272 |

* cited by examiner

*Primary Examiner* — Ali Alavi
(74) *Attorney, Agent, or Firm* — Montgomery Patent & Design; Robert C. Montgomery

(57) ABSTRACT

A track-mounted decorative lighting system comprises a track system, a light string, and a motorized lighting cartridge. The track system comprises a flexible track with an inverted "T"-shape profile mounted by a user in a desired configuration upon a structure. The motorized lighting cartridge comprises a gear-type drive system which deploys or retracts the light string through the track. A user may use a hand-held remote controller to activate the internal motor to drive the lights out into position along the track system upon the structure. The lighting system provides a means to add additional light strings and light cartridges to obtain a greater length of deployed lighting. The motor withdraws the deployed lights back into the cartridge for storage. The lighting system further provides a hook embodiment onto which a user may secure existing string-type lighting while still utilizing the deployment and retraction functions.

20 Claims, 7 Drawing Sheets

TRACK-MOUNTED DECORATIVE LIGHTING APPARATUS

RELATED APPLICATIONS

There are no current applications co-pending with the current application.

FIELD OF THE INVENTION

The present invention relates generally to decorative lighting, and in particular, to track-mounted motorized systems which deploys and retracts the lighting.

BACKGROUND OF THE INVENTION

Holiday lights are well known decorations for external surfaces of structures or homes. The process of setting-up the lights and removing the lights is relatively long. Many times the lights remain set up for months after the holiday due to the removal inconvenience. Additionally, putting up and taking down of such lights typically require the use of a ladder, which is a safety issue.

Various attempts have been made to provide a decorative lighting system. Examples of these attempts can be seen by reference to several U.S. patents. U.S. Pat. No. 5,154,509, issued in the name of Wulfman et al., describes a magnetic track lighting system.

U.S. Pat. No. 6,183,104, issued in the name of Ferrara, describes a decorative lighting system on a support structure.

U.S. Patent No. 2007/0211453, issued in the name of Hamburger, describes a permanently installed lighting system.

While these systems fulfill their respective, particular objectives, each of these references suffer from one (1) or more disadvantages. Many systems are not suited to be easily utilized or user friendly. Many other systems are permanently installed onto the structure. Furthermore with all these systems, too many parts are used which makes storage complicated.

SUMMARY OF THE INVENTION

The inventor has recognized the aforementioned inherent problems and lack in the art and observed that there is a need for a decorative lighting system.

Accordingly, it is an object of the present embodiments of the invention to solve at least one (1) of these problems. The inventor has addressed this need by developing track-mounted decorative lighting system that provides an ease of use during set-up, removal, and storage.

To achieve the above objectives, it is an object of the present invention to provide a light strip assembly and a means to deploy the light strip assembly along a track section which is stationarily mounted to a structure.

Another object of the present invention is to provide a motorized cartridge assembly to provide automatic extension or retraction of the light strip assembly through the track section.

Yet still another object of the present invention is to provide remote activation to deploy the light strip assembly via a wireless interface between a motor and a remote controller.

Yet still another object of the present invention is to transmit an RF signal which is received by a control box located within said cartridge assembly, to deploy/retract the light strip assembly.

Yet still another object of the present invention is to provide a common power cord to receives electrical power from a standard 120 VAC outlet receptacle.

Yet still another object of the present invention is to have the power cord in direct electrical communication with the control box via wiring.

Yet still another object of the present invention is to provide the control box with a microprocessor-based electronic module capable of managing embedded software and switching power to the motor to motion said light strip assembly in both a forward and reverse direction within the track section.

Yet still another object of the present invention is to provide an alternate hook embodiment to provide a means to utilize existing string-like lighting.

Yet still another object of the present invention is to enable the alternate hook embodiment to attach string-type lighting equipment to a third drive member portion via hook fixtures.

Yet still another object of the present invention is to provide a method of utilizing the device that provides a unique means of procuring a model of the decorative light system having desired color bulbs as well as any additional light strip assemblies and light strip extensions required to create a desired length of holiday lighting based upon particular features of a structure, mounting at least one track section in a continuous linear manner along the features of the structure, positioning the cartridge assembly upon the structure so as to align the track connector portion of the cartridge assembly to a proximal end portion of the track section, plugging the power cord, manipulating the remote controller, adding additional strip extensions as needed, and utilizing the hook embodiment as needed.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings in which like elements are identified with like symbols and in which:

DESCRIPTIVE KEY

| | |
|---|---|
| 10 | track-mounted decorative lighting apparatus |
| 20 | light strip assembly |
| 22 | first bulb holder |
| 24 | first drive member |
| 26a | first rack gear |
| 26b | second rack gear |
| 28 | male connector |
| 30 | female connector |
| 32 | bulb |
| 50 | track section |
| 51 | adapter |
| 52 | inner channel |
| 54 | track connector |
| 60 | cartridge assembly |
| 61 | aperture |
| 62 | housing |
| 63 | support channel |
| 64 | gear support plate |
| 66 | motor support plate |
| 68 | mounting hook |
| 70 | mounting bracket |
| 72 | light strip support plate |
| 73 | light strip slot |
| 74 | divider panel |
| 80 | motor |
| 82 | control box |
| 84 | drive shaft |
| 85 | first gear |
| 86 | second gear |
| 88 | reduction gear |
| 90 | idler gear |
| 92 | magnetic strip |
| 94 | sensor |
| 96 | power cord |
| 98 | light strip plug |
| 100 | remote controller |
| 102 | radio frequency (RF) signal |
| 120 | light strip extension |
| 122 | second bulb holder |
| 124 | second drive member |
| 130 | end cap |
| 150 | threaded fastener |
| 152 | wiring |
| 170 | hook embodiment |
| 174 | third drive member |
| 176 | hook fixture |
| 178 | existing string-type lighting |
| 200 | structure |
| 202 | fascia board |

DETAILED DESCRIPTION OF THE PREFERRED EMBODIMENT

Figure 5:
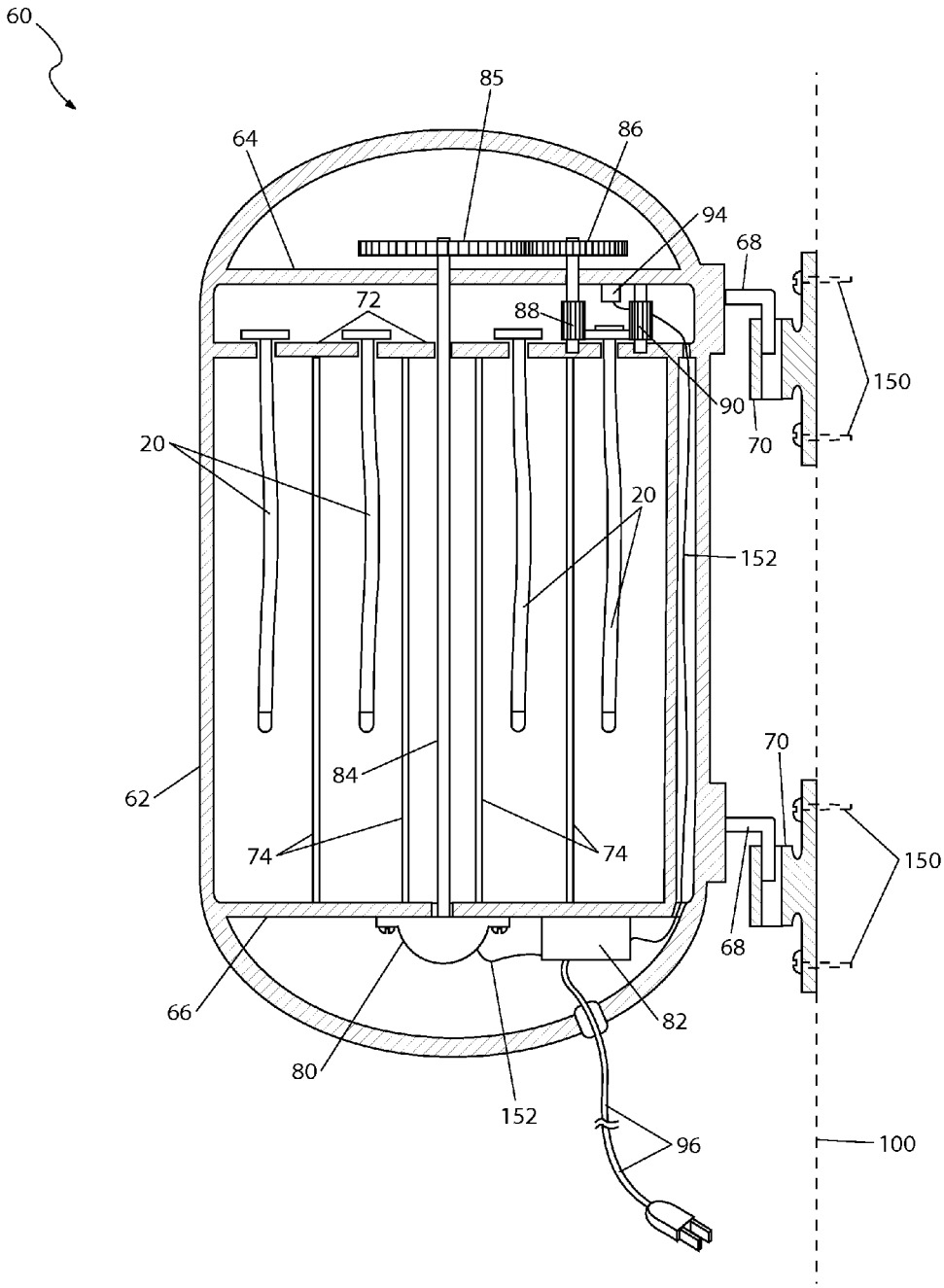
FIG. 5 is a section view of a cartridge assembly portion 60 of the track-mounted decorative lighting apparatus 10 taken along a vertical center line, according to the preferred embodiment of the present invention.
Figure 6:
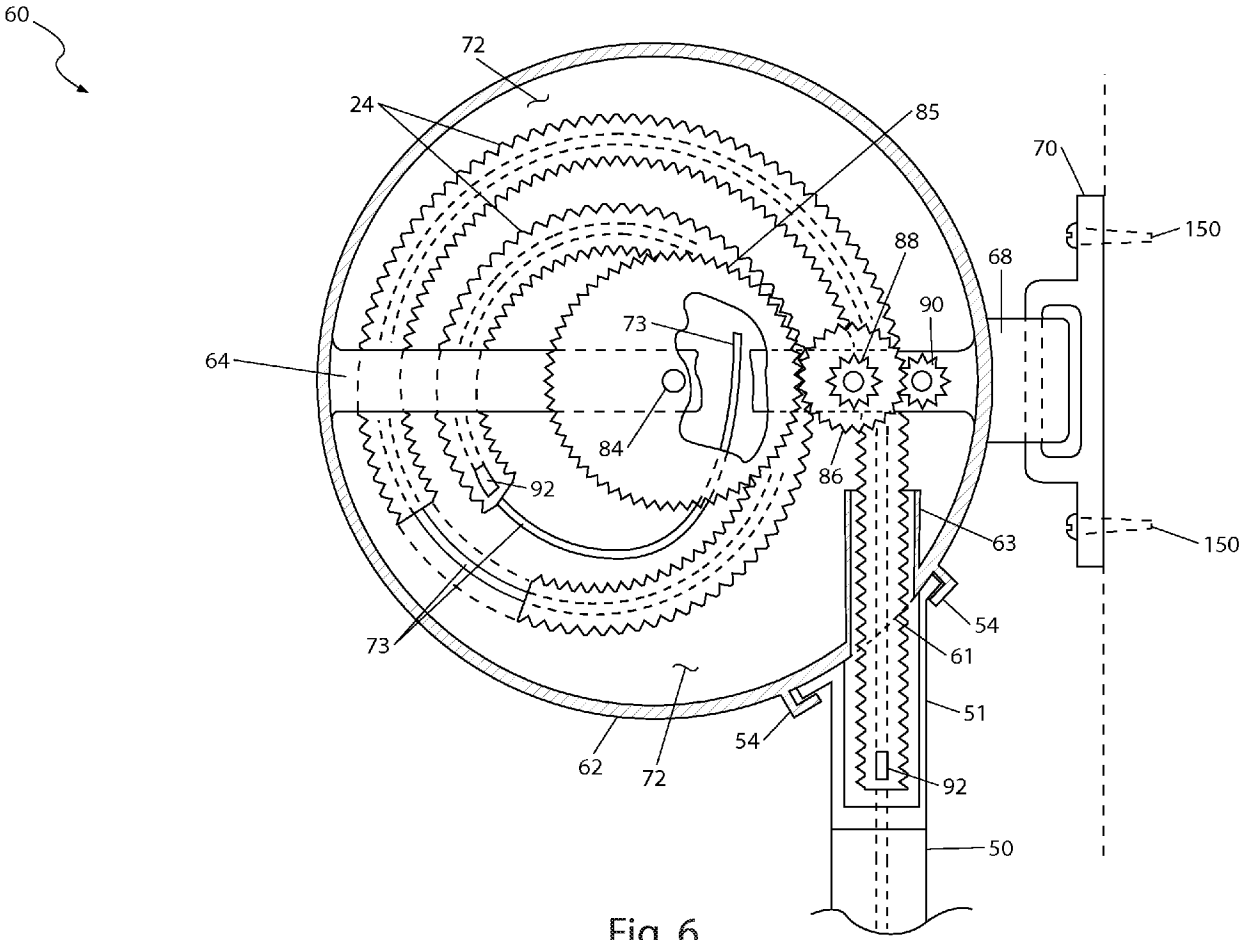
FIG. 6 is another section view of the cartridge assembly portion 60 of the track-mounted decorative lighting apparatus 10 taken along section line C-C (see FIG. 5), according to the preferred embodiment of the present invention; and, FIG. 7 is a perspective view of a hook embodiment 170 of the invention, according to an alternate embodiment of the present invention.
Figure 7:
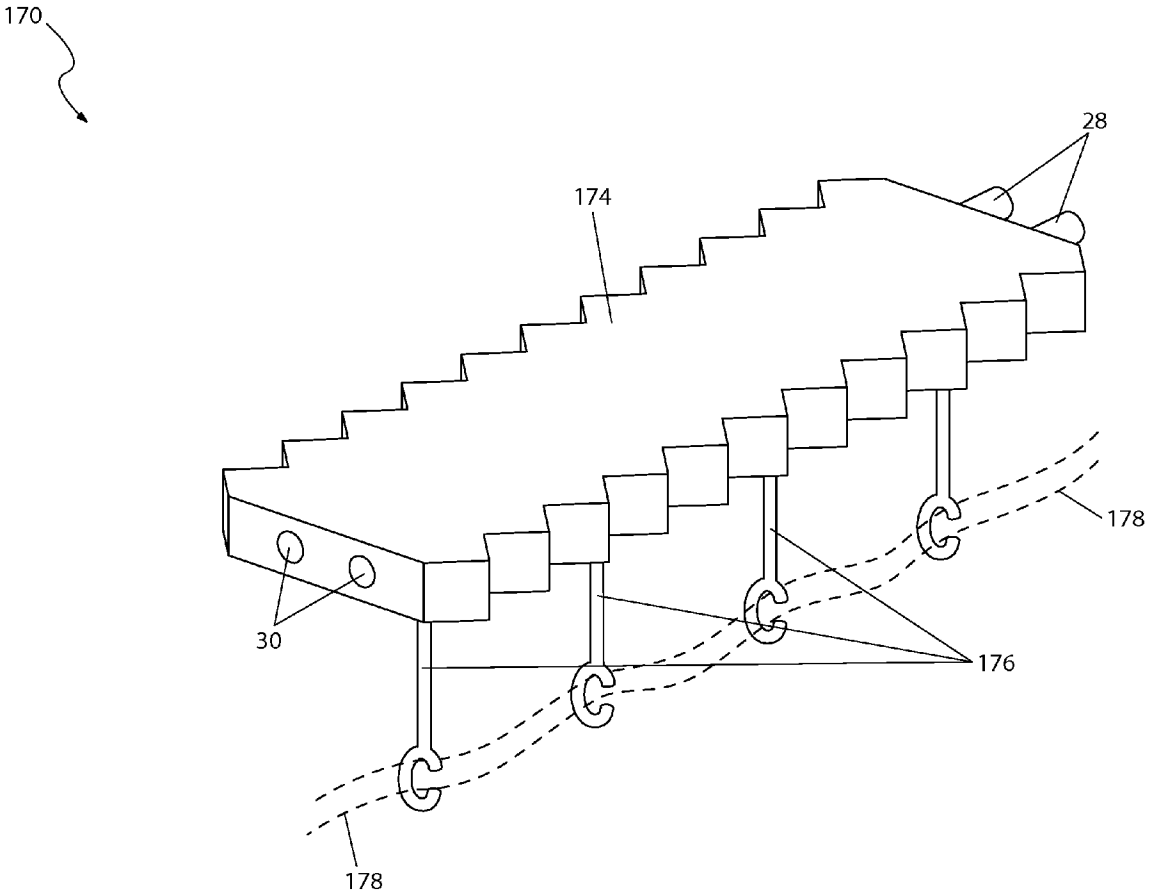

The best mode for carrying out the invention is presented in terms of its preferred embodiment, herein depicted within FIGS. 1 through 6, and in terms of alternate embodiments herein depicted in FIG. 7. However, the invention is not limited to the described embodiment, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

Figure 1:
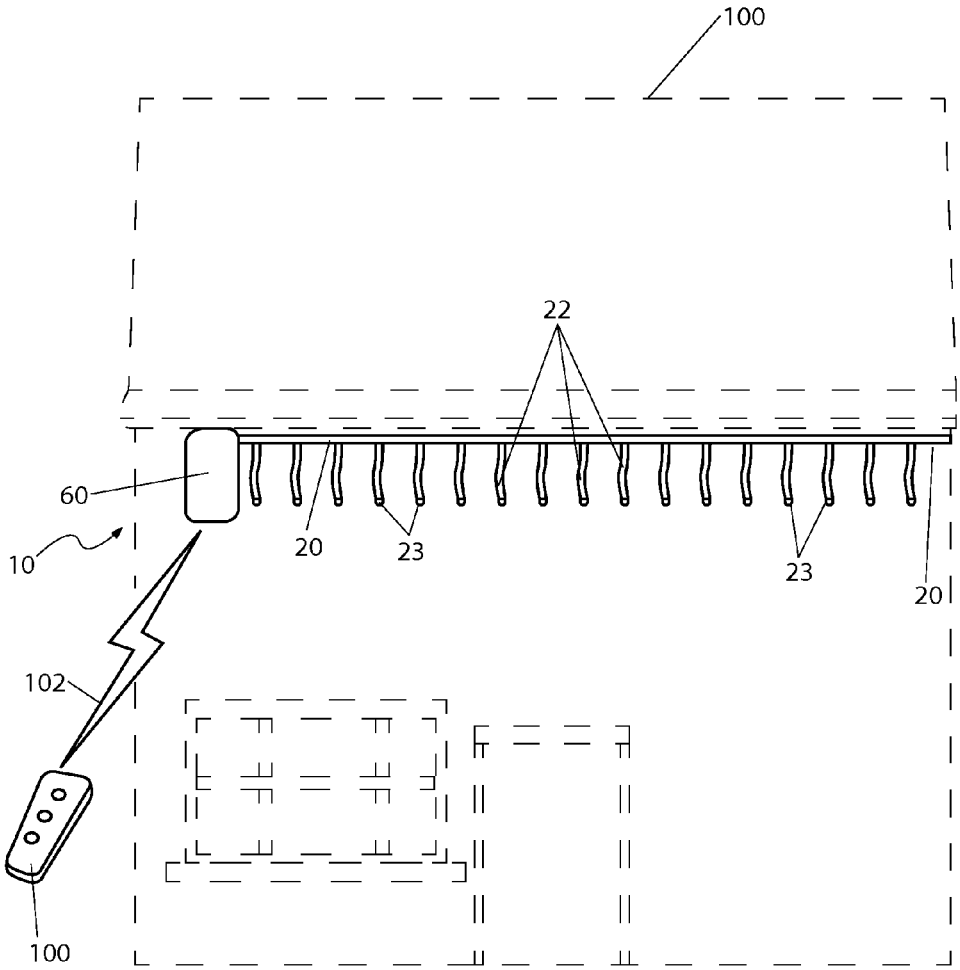
FIG. 1 is an environmental view of a track-mounted decorative lighting apparatus 10 depicted as connected to an exterior wall of a structure 200, according to a preferred embodiment of the present invention.

Referring now to FIG. 1, an environmental view of the track-mounted decorative lighting apparatus (herein referred to as the "apparatus") 10, depicted here being affixed to a fascia board portion 202 of a structure 200, according to a preferred embodiment of the present invention, is disclosed. The apparatus 10 provides a "T"-shaped outdoor holiday light strip assembly 20, and a means to deploy said light strip assembly 20 along a track section 50 which is stationarily mounted to the structure 200. The track section 50 is to be mounted in an inverted orientation and may also be affixed to a roof line, an overhang, a railing, or other features of the structure 200 commonly used to support holiday lights. The apparatus 10 further comprises at least one (1) cylindrical motorized cartridge assembly 60 which provides automatic extension or retraction of the light strip assembly 20 through said track section 50. The cartridge assembly 60 further provides a means to remotely activate and deploy said light strip assembly 20 via wireless interface between a motor 80 and a remote controller 100. Said remote controller 100 transmits an RF signal 102 which is in turn received by a control box 82 located within said cartridge assembly 60, thereby deploying/retracting the light strip assembly 20. Said remote controller 100 is envisioned to comprise a plurality of surface-mounted buttons to wirelessly initiate such functions as "DEPLOY", "RETRACT" to motion the light strip assembly 20, as well as "ON" and "OFF" functions to illuminate the lamps 32. The apparatus 10 is intended to make putting up holiday lights 22 take a matter of minutes instead of a number of hours.

Figure 2:
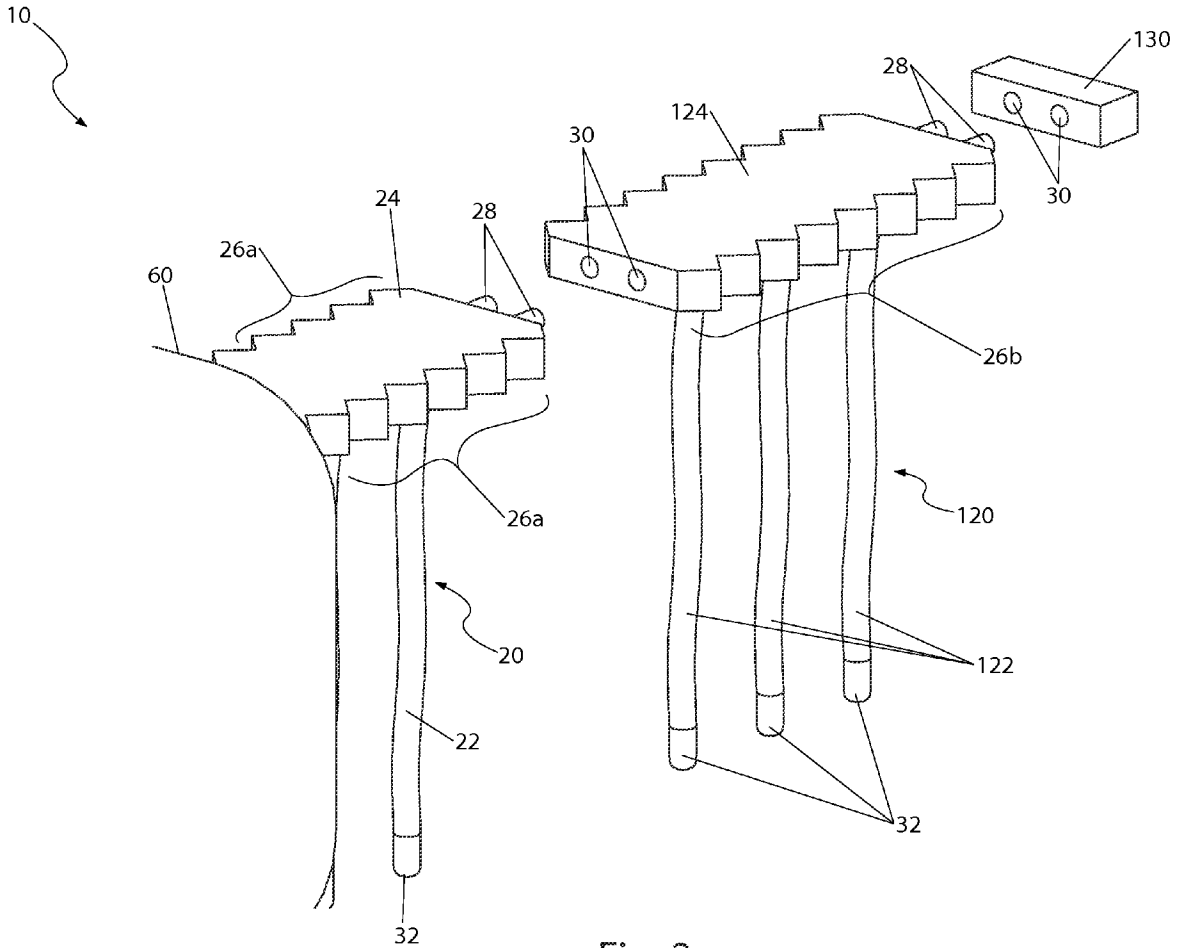
FIG. 2 is an exploded view of disconnected light strip assembly 20, light strip extension 120, and end cap 130 portions of the track-mounted decorative lighting apparatus 10, according to the preferred embodiment of the present invention.

Referring now to FIG. 2, an exploded view of disconnected light strip assembly 20, light strip extension 120, and end cap 130 portions, according to the preferred embodiment of the present invention, is disclosed. The apparatus 10 may be introduced as a unitary lighting strip assembly 20 being contained within a unitary cartridge assembly 60, or may also comprise additional lighting components and cartridge assemblies 60 in a modular fashion so as to create a desired overall length of holiday lights. Based upon a desired lighting arrangement, the apparatus 10 may comprise a combined connection of at least one (1) light strip assembly 20, at least one (1) light strip extension 120, a decorative end cap 130, and a corresponding number of cartridge assemblies 60 to contain said light strip assemblies 20 and light strip extensions 120. The cartridge assembly 60 is designed to be easily removed from the structure 200 and replaced with additional cartridge assemblies 60 via "lift-off" mounting brackets 70 (see FIGS. 5 and 6).

Said light strip assemblies 20 are envisioned to be provided in various incremental lengths between approximately twenty (20) and fifty (50) feet having various desired color bulbs 32 being arranged in an equally-spaced manner approximately six (6) inches to two (2) feet apart. In like manner, the light strip extensions 120 are envisioned to be provided in various lengths of approximately one (1) to five (5) feet, thereby allowing a user to combine a number of strip assemblies 20 and light strip extensions 120 to obtain a desired specific overall length. Finally, the end cap 130 is added to a distal end portion of said light strips 20, 120 to provide protection against weather elements as well as to provide a decorative appearance. Each light strip assembly 20 and light strip extension 120 includes mating pin-type male connections 28 at one (1) end and female connections 30 at an opposite end, which provide both mechanical and an electrical communication between adjacent light strip sections 20, 120 as well as providing a mechanical connection to the end cap 130. Said male 28 and female 30 connections allow for additional lengths of light strips 20, 120 to be attached for continuation of the apparatus 10 while maintaining electrical communication and connectivity between.

Figure 4:
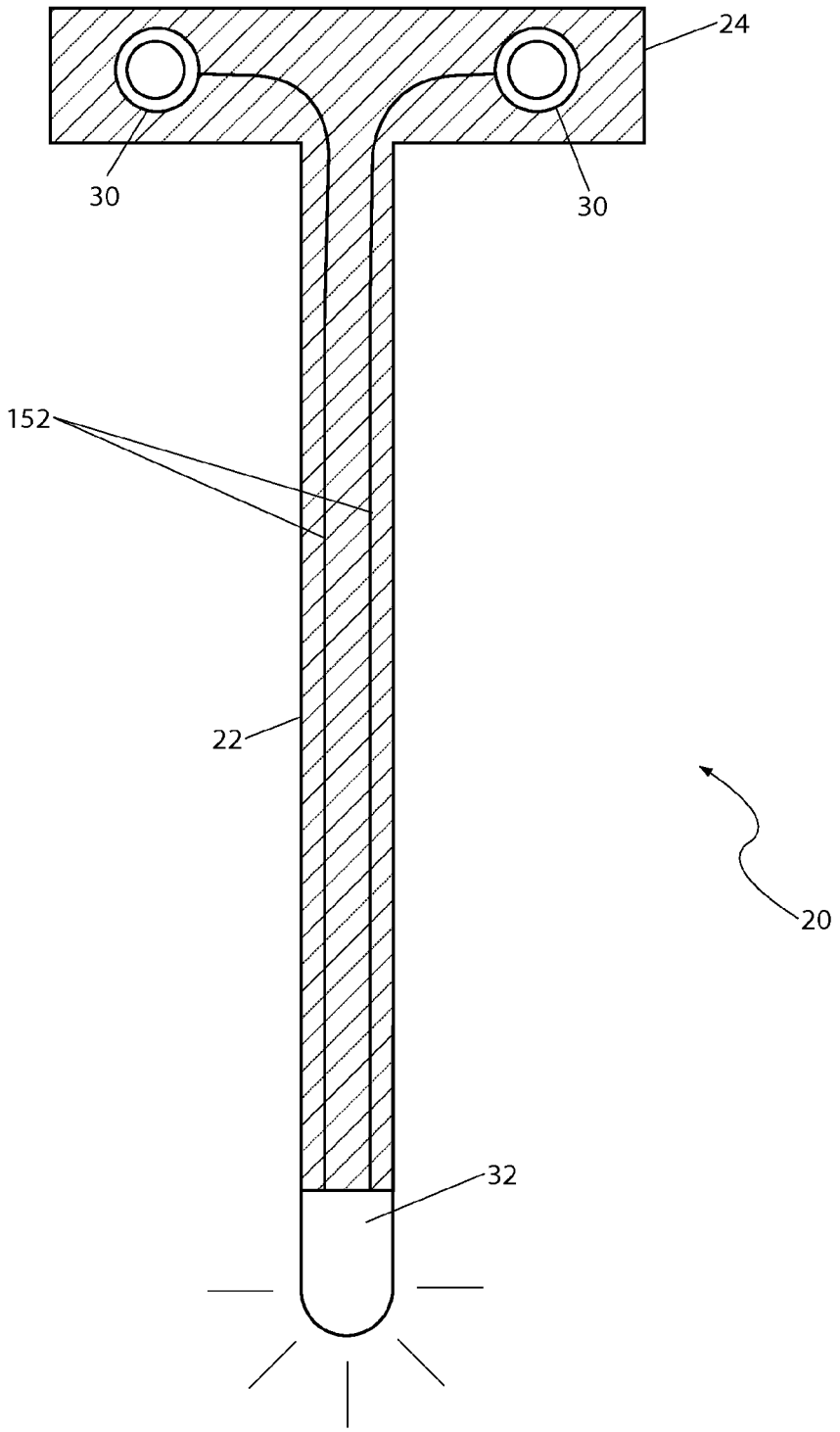
FIG. 4 is another section view of a first bulb holder portion 22 of the track-mounted decorative lighting apparatus 10 taken along section line B-B (see FIG. 3), according to the preferred embodiment of the present invention.

Each light strip assembly 20 and light strip extension 120 further comprises a "T"-shaped construction with vertical first 22 and second 122 bulb holders, and horizontal first 24 and second 124 drive members, respectively (see FIG. 4). Said drive member portions 24, 124 comprise a top horizontal portion further comprising respective first rack gear 26*a* and second rack gear 26*b* portions along opposing edges which enable the motorized cartridge assembly 60 to mechanically engage and motion said light strip portions 20, 120 through the track section 50 (see FIGS. 5 and 6).

Figure 3:
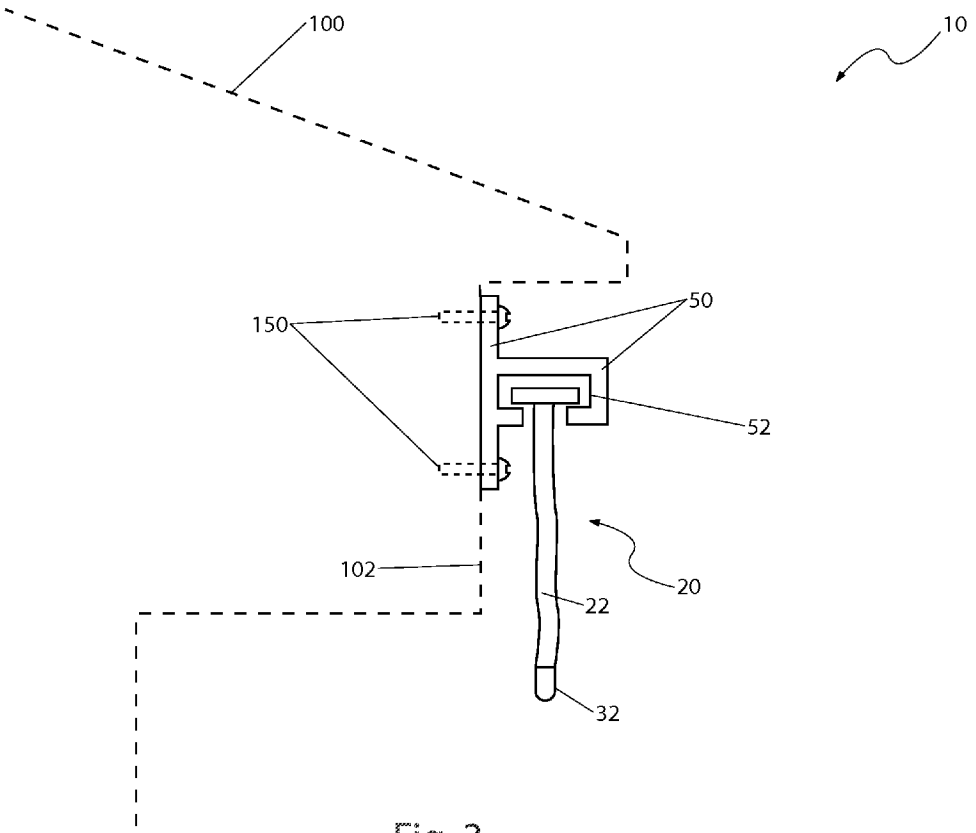
FIG. 3 is a section view of the light strip assembly 20 and track 50 portions of the track-mounted decorative lighting apparatus 10 taken along section line A-A (see FIG. 1), according to the preferred embodiment of the present invention.

Referring now to FIG. 3, a section view of the light strip assembly 20 and track section 50 portions of the apparatus 10 taken along section line A-A (see FIG. 1), according to the preferred embodiment of the present invention, is disclosed. The apparatus 10 comprises at least one (1) light strip assembly 20 and at least one (1) supporting track section 50. The track section 50 includes a generally "T"-shaped inner channel 52 and is made using a semi-rigid synthetic material such as nylon, urethane, TEFLON®, or the like, being of a compliant bendable nature in order to follow the contours and obstacles of the structure 200 to which it is mounted. It is envisioned that a plurality of track sections 50 may be provided and may be mounted in an end-to-end manner as well as being cut to length so as to match an overall combined length of the light strip assemblies 20 and light strip extensions 120. The light strip assemblies 20 and extensions 120 are driven through the inner channel 52 of the track section 50 by the motorized portion 80 of the cartridge assembly 60 (see FIGS. 5 and 6).

Referring now to FIG. 4, a section view of light strip portions 20, 120 of the apparatus 10 taken along section line B-B (see FIG. 3), according to the preferred embodiment of the present invention, is disclosed. Each light strip assembly 20 and light strip extension 120 further comprises a "T"-shaped construction with respective vertical first 22 and second 122 bulb holders, and horizontal first 24 and second 124 drive members. Said bulb holders 22, 122 are envisioned to be approximately six (6) to twelve (12) inches in length and approximately one-half (½) inch thick. Said bulb holders 22, 122 provide a decorative means to route a plurality of internal wires 152 in a weather-proof manner to a plurality of respective subjacent bulbs 32. Said wiring 94 is routed along a length of said light strips 20, 120 and to each bulb 32 being in electrical communication with the previously described male 28 and female 30 connectors (see FIG. 2). The bulbs 32 are preferably light emitting diodes (LED); however, other equivalent bulb technologies may be utilized as well to create a desired lighting effect.

Referring now to FIGS. 5 and 6, respective vertical and horizontal section views of the cartridge assembly portion 60 of the apparatus 10, according to the preferred embodiment of the present invention, are disclosed. The cartridge assembly 60 provides a storage means as well as a means to propel the contained light strip assembly 20 through the track section 50. The cartridge assembly 60 comprises a cylindrical housing 62 further comprising internal horizontal structures including a gear support plate 64, a motor support plate 66, and a light strip support plate 72, onto which internal equipment is mounted. Said light strip support plate 72 further comprises a light strip slot 73 arranged in a spiral pattern being designed to compactly store the light strip assembly 20 within the cartridge 60 in a vertically hanging, and a ready to deploy position. The cartridge 60 further comprises a semi-rigid plastic divider panel 74 which extends between a top surface portion of the motor support plate 66 and a bottom surface of the light strip support plate 72. Said divider panel 74 is secured to said support plates 66, 72 being arranged in a spiral pattern with respect to the light strip assembly 20 so as to separate circular wrappings of said light strip assembly 20, thereby avoiding possible tangling of the first bulb holder portions 22.

The cartridge assembly 60 comprises a support channel 63 located inwardly from an inner surface and providing a means to rout the light strip assembly 20 from the means to deploy the light strip assembly 20 to the outer aperture 61 for subsequent conveyance along the track section 50.

The cartridge assembly 60 provides removable attachment to an end portion of a previously mounted track section 50 via interlocking attachment of a male-shaped track adapter 51 and an integral female-shaped track connector portion 54 of the cartridge assembly 60 being located at an equal elevation as the light strip support plate 72 along an outer surface. Said track adapter 51 and track connector 54 portions provide an aligned entrance and egress means of the light strip assembly 20 as well as aid in positioning said cartridge 60 at a matched elevation with said receiving track section 50 which is attached to the structure 200.

The motorized cartridge assembly 60 provides a pushing and pulling force to the light strip assembly 20 which enables said light strip assembly 20 to "flow" through the inner channel portion 52 of the track section 50. The cartridge assembly 60 comprises a motor 80, a control box 82, a drive shaft 84, a first gear 85, a second gear 86, a reduction gear 88, an idler gear 90, a power cord 96, and a light strip plug 98. The motor support plate 66 creates an internal area within a bottom portion of the housing 62 which is envisioned to contain the motor 80 and the control box 82 being affixed to a bottom surface of said motor support plate 66. Electrical power is provided to the cartridge assembly 60 via a common power cord 96 which receives electrical power from a standard 120 VAC residential or commercial outlet receptacle. Said power cord 96 is in direct electrical communication with the control box 82 via common wiring 152. Said control box 82 comprises a microprocessor-based electronic module capable of managing embedded software and switching power to the motor 80 to motion said light strip assembly 20 in both a forward and reverse direction within the track section 50. The motor 80 comprises a common AC or DC electrical motor having a vertical drive shaft 84 which extends upwardly along a vertical centerline of the housing 62 to an area above the gear support plate 64. Said drive shaft 84 is in turn in mechanical communication with a gear drive assembly which is envisioned to include a first gear 85 which drives a second gear 86 having a subjacent reduction gear 88 along a common shaft. Said reduction gear 88 in turn engages the aforementioned first 26*a* and second 26*b* rack gear portions 26*a* of the first 24 and second 124 drive members, respectively (see FIG. 2). An idler gear 90 is positioned opposite to said reduction gear 88 to engage and entrap the drive members 24, 124 between. When the motor 80 is energized by the remote controller 100, the reduction gear 88 drives the first rack gear 26*a* to motion the light strip assembly 20 within the track section 50.

A unitary light strip assembly 20 or a connected combination of light strip assemblies 20 and light strip extensions 120 define a length of holiday lighting which further comprises an adhesively affixed magnetic strip 92 at each end portion which provides a means to sense a position of the light strips 20, 120 and to automatically halt the motor 80. Said motor 80 is halted at such times as the lighting strips 20, 120 being completely retracted or completely deployed from the cartridge assembly 60. Said magnetic strips 92 work in conjunction with a proximity sensor 94 mounted within the cartridge assembly 60 adjacent to the track connector 54, which sends an electrical signal to the control box 82 upon detection of said magnetic strip 92, to halt said motor 80.

The apparatus 10 provides a means whereby more than one (1) light strip assembly 20 may be utilized along a length of track section 50 via attachment of additional cartridges 60. The cartridge assembly 60 is envisioned to be mounted to the structure 200 via a pair of integral mounting hooks 68 and receiving mounting brackets 70, thereby allowing easy "lift off" removal of the cartridge assembly 60 from the structure 200. The detachable track adapter 51 and track connector 54 portions, as well as the male 28 and female 30 connector portions of the light strip assemblies 20, allow easy attachment of additional light strip assemblies 20. Furthermore, each cartridge assembly 60 comprises an external light strip plug 98 comprising a pair of male connector portions 28 which provide for easy electrical connection to a proximal end portion of a deployed light strip assembly 20. Said light strip plug 98 is in electrical communication with the control box 82, thereby conducting electricity to illuminate the lamps 32 when desired, using the remote controller 100.

Referring now to FIG. 7, a perspective view of a hook embodiment 170 of the invention, according to an alternate embodiment of the present invention, is disclosed. The hook embodiment 170 provides a means to utilize existing string-like lighting 178 as an alternate to the previously described light strip assembly 20 by allowing a user to attach various string-type lighting equipment 178 to a third drive member portion 174 via a plurality of hook fixtures 176. The hook embodiment 170 utilizes the cartridge assembly 60 in a similar manner as the light strip assemblies 20 to retract, store, and deploy said hook embodiment portion 170. The hook embodiment 170 comprises a third drive member 174 being similar in construction as the previously described first drive member 24. Said third drive member 174 further comprises a plurality of integrally-molded and downwardly hanging hook fixtures 176 in lieu of the first bulb holder portions 22 of the light strip assemblies 20. Said hook fixtures 176 further comprise equally-spaced vertical rod portions which extend downwardly approximately six (6) to twelve (12) inches, each having an integral oval-shaped hook feature at an end portion which provides a center opening portion suitable to partially encompass and secure the string-type lighting 178 within. The hook embodiment 170 allows the existing string-type lighting 178 to be affixed to said hook fixtures 176 and then be retracted and deployed from the cartridge assembly 60 in a similar manner as the light strip assemblies 20 using the motor 80 and remote controller 100 as previously described.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1.

The method of installing and utilizing the apparatus 10 may be achieved by performing the following steps: procuring a model of the apparatus 10 having desired color bulbs 32 as well as any additional light strip assemblies 20 and light strip extensions 120 required to create a desired length of holiday lighting based upon particular features of a structure 200; loading a fresh set of batteries into the remote controller 100; mounting at least one (1) track section 50 in a continuous linear manner along the features of the structure 200 commonly used to support holiday lights, such as a fascia board, a roof line, an overhang, a railing, and the like; positioning the cartridge assembly 60 upon the structure 200 so as to align the track connector portion 54 of the cartridge assembly 60 to the track adapter 51 being positioned at the proximal end portion of the track section 50; mounting said cartridge assembly 60 to the structure 200 by attaching the mounting brackets 70 to said structure 200 using the threaded fasteners 150 and engaging the corresponding mounting hook portions 68 of the cartridge assembly 60; aligning the track section 50 with the track adapter 51; attaching the track adapter 51 to the track connector portion 54 of the cartridge assembly 60; plugging the power cord 96 into a household electrical outlet; deploying the light strips 20, 120 by pressing the "DEPLOY" button portion of the remote controller 100; deploying a desired length of lighting 20, 120 into the track section 50 or continuously deploying said lighting 20, 120 until the magnetic strip portion 92 of the light strip 20, 120 is detected by the sensor 94, thereby automatically halting the motor 80; connecting the female connector portion 30 of the deployed light strip assembly 20 to the light strip plug 98 upon the cartridge assembly 60; using the remote controller 100 to illuminate the lamps 32 when desired by pressing the "ON" button portion; utilizing the holiday lights in a conventional manner as desired; pressing the "OFF" button portion of the remote controller 100 to turn off the lamps 32; retracting the light strips 20, 120 into the cartridge assembly 60 when desired by pressing the "RETRACT" button on the remote controller 100; and, saving time and effort required to display and store holiday lighting 20, 120 while utilizing the present invention 10.

The method of adding additional light strip assemblies 20 and/or light strip extensions 120 to the apparatus 10 may be achieved by performing the following steps: deploying an initial light strip assembly 20 as previously described; disconnecting the track connector 54 portion of the cartridge assembly 60 from the track section 50; unplugging the power cord portion 96 of the cartridge assembly 60 from the power source; lifting the empty cartridge assembly 60 off the mounting brackets 70 and setting it aside; mounting an additional cartridge assembly 60 onto said mounting brackets 70 as previously described; connecting the track connector 54 to the track section 50; connecting the male connector portion 28 of the additional light strip assembly 20 to the female connector portion 30 of the previously deployed light strip assembly 20; deploying the additional light strip assembly 20 using the remote controller 100 as previously described; and, repeating the process to add additional cartridge assemblies 60 and light strip assemblies 20 as desired.

The method of installing and utilizing the hook embodiment 170 may be achieved by performing the following steps: procuring the apparatus 10 having at least one (1) cartridge assembly 60 loaded with the alternate hook embodiment 170; mounting the cartridge assembly 60 and track section 50 to the structure 200 as previously described; deploying the hook embodiment 170 using the remote controller 100 as previously described; connecting the existing string-type lighting 178 to the hook fixtures 176 in a linear fashion; illuminating the existing string-type lighting 178 by connecting said existing string-type lighting 178 to an available power source in a conventional manner; utilizing said existing string-type lighting 178 as desired; disconnecting the existing string-type lighting 178 from the power source; and, retracting the hook embodiment 170 along with the attached existing string-type lighting 178 into the cartridge assembly 60 for storage in a similar manner as the previously described preferred embodiment of the apparatus 10. It is understood that the apparatus 10 may also be connected to lighting which provides special illumination effects, such as but not limited to, programmable light strips which provide customized computer coordination with musical tracts and the like.

The apparatus 10 is envisioned to be used during holidays such as, but not limited to: Christmas, Halloween, Independence Day, Memorial Day, Easter, and other such holidays or occasions.

It is envisioned that the apparatus 10 would be made available in multiple colors to match varying house decors.

Additionally, it is envisioned that track section portions 50 of the apparatus 10 may incorporate embedded integral heating elements in cold climate areas to eliminate ice build up on said track section 50.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A track-mounted decorative lighting apparatus, comprising:

a cartridge assembly, comprising a cartridge housing adapted to be mounted with a cartridge mounting means;

a track section having a first end removably attached to said cartridge housing and a second end, said track system adapted to be mounted with a plurality of track mounting means;

an illumination assembly, comprising an illumination body retaining and supporting an illumination means depending downward from said illumination body, said illumination assembly deployable along and suspended from said track section;

a deploying means housed within said cartridge housing operably connected to said illumination assembly, said deploying means for advancing said illumination assembly outward from said cartridge enclosure;

a control means for operably controlling said deploying means and in electrical communication with said deploying means and said illumination means; and, a remote control in wireless communication with said control means, said remote control providing control to said deploying means and said illumination means;

wherein said cartridge assembly further comprises storage to said track section and said illumination assembly when fully retracted therein; and, wherein said cartridge assembly and said track section is adapted to be mounted to a support structure.

2. The apparatus of claim 1, wherein said cartridge housing comprises a cylindrical housing further comprising:

an aperture located at an upper location of said housing;

a gear support plate spanning across an upper portion of an interior of said cartridge enclosure;

an illumination assembly support plate spanning across an upper portion of an interior of said cartridge housing subjacent from said gear support plate, further comprising a slot arranged in a spiral pattern;

a motor support plate spanning across a bottom portion of an interior of said cartridge enclosure;

a semi-rigid divider panel extending between a top surface of said motor support plate and a bottom surface of said illumination assembly support plate, said divider panel arranged in a spiral pattern adjacent to said slot;

a support channel located inwardly from an inner surface opposite said aperture; and, a track connector located on an outer surface of said cartridge housing on opposing sides of said aperture;

wherein said illumination assembly support plate is arranged in a spiral pattern, thereby providing a compact storage for said illumination assembly within said cartridge housing in a vertically suspended position;

wherein said support channel provides a guide for said illumination assembly traveling from said deploying means outward through said aperture; and, wherein said divider plate separates wrappings of said illumination assembly, thereby preventing entanglement thereof.

3. The apparatus of claim 2, further comprising an adapter piece providing a removable connection between said track section and said cartridge assembly, said adapter piece comprising a first end having a profile corresponding to an outer surface of said cartridge housing and removably connected to said track connector and a second end removably attached to said first end of said track portion;

wherein said track connector provides an aligned entrance and egress means of said illumination assembly.

4. The apparatus of claim 3, wherein said cartridge mounting means is at least one integral mounting hook extending outwardly from said cartridge housing removably attached to a receiving mount.

5. The apparatus of claim 3, wherein said track section further comprises an elongated track body comprising a semi-rigid compliant material and having a generally "T"-shaped inner channel and a mounting plate for receiving said track mounting means;

wherein said illumination assembly travels within said inner channel.

6. The apparatus of claim 5, wherein said illumination body further comprises an elongated "T"-shaped member having a first end affixed to said cartridge housing and a second end, comprising a drive member and a plurality of equidistantly-spaced downwardly depending illumination holders;

wherein said illumination body further comprises a resilient and flexible construction;

wherein said drive member is mechanically advanced by said deploying means; and, wherein said drive member is captured within said track channel.

7. The apparatus of claim 6, wherein said illumination means further comprises:

a plurality of illuminating lamps, each suspended from a bottom portion of an individual illumination holder; and, at least one pin-type male connection in electrical communication with said plurality of illuminating lamps and a power source, said at least one male connection extending outward from said illumination body second end.

8. The apparatus of claim 7, further comprising at least one extension illumination assembly, each further comprising:

an extension illumination body, comprising an elongated "T"-shaped member having a extension first end and an extension second end, comprising an extension drive member and a plurality of equidistantly-spaced downwardly depending illumination holders; and, an extension illumination means, further comprising:

a plurality of illuminating lamps, each suspended from a bottom portion of an individual illumination holder;

at least one pin-type male connection in electrical communication with said plurality of illuminating lamps, said at least one male connection extending outward from said extension illumination body second end; and, at least one female connection in electrical communication with said plurality of illuminating lamps, said at least one female connection located on said extension illumination body first end;

wherein said extension illumination body further comprises a resilient and flexible construction;

wherein said extension drive member is mechanically advanced by said deploying means when attached to said drive member;

wherein said extension drive member is captured within said track channel; and, wherein said at least one female connection is removably attached to and in electrical communication with an adjacent illumination body male connection or extension male connection.

9. The apparatus of claim 7, further comprising an end cap, comprising a pair of receiving apertures along a first end thereof.

10. The apparatus of claim 5, wherein said deploying means further comprises:

a reversible motor mounted onto said motor support plate and in electrical communication with said control means;

a drive shaft extending vertically through said motor support plate, said illumination assembly support plate, and said gear support plate and terminating at a distal end;

a first gear in mechanical communication with said drive shaft and operably controlled thereby;

a second gear in mechanical communication with said first gear and operably controlled thereby;

a gear shaft in mechanical communication with said second gear and operably controlled thereby, said gear shaft extending vertically downward through said gear support plate and supported on said illumination assembly support plate;

a reduction gear in mechanical communication with said gear shaft and operably controlled thereby; and, an idler gear supported on said illumination assembly support plate positioned opposite said reduction gear;

wherein said motor is operable controlled by said control means;

wherein said motor drives said drive shaft, said first gear, said second gear, said gear shaft, and said reduction gear; and, wherein said reduction gear drives said drive member of said illumination assembly towards said support channel and said idler gear assist in guiding said drive member.

11. The apparatus of claim 10, wherein said control means further comprises:

a control box mounted to said motor support plate and in electrical communication with said motor;

a power supply cord in electrical communication with said control box, said power supply cord routed through a wall of said cartridge housing;

a pair of magnetic strips, each affixed at an upper surface adjacent to said first end and said second end of said illumination body;

a proximity sensor mounted to a bottom surface of said gear support plate along a centerline between said reduction gear and said idler gear, said proximity sensor in electrical communication with said control box;

wherein said control box supplies control to said deploying means and said illumination means;

wherein said control box is in wireless communication with said remote control;

wherein said proximity sensor generates and transmits a stop signal to said control box for ceasing motion of said motor upon sensing either one of said magnetic strip.

12. A track-mounted decorative lighting apparatus, comprising:

a cartridge assembly, comprising a cartridge housing adapted to be mounted with a cartridge mounting means;

a track section having a first end removably attached to said cartridge housing and a second end, said track system adapted to be mounted with a plurality of track mounting means;

an illumination suspension assembly comprising an illumination suspension body, said illumination suspension assembly deployable along and suspended from said track section;

a deploying means housed within said cartridge housing operably connected to said illumination suspension assembly, said deploying means for advancing said illumination suspension assembly outward from said cartridge enclosure;

a control means for operably controlling said deploying means and in electrical communication with said deploying means; and, a remote control in wireless communication with said control means, said remote control providing control to said deploying means;

wherein said cartridge assembly further comprises storage to said track section and said illumination suspension assembly when fully retracted therein;

wherein said illumination suspension body is adapted to retain and support an illumination means depending downward therefrom; and, wherein said cartridge assembly and said track section is adapted to be mounted to a support structure.

13. The apparatus of claim 12, wherein said cartridge housing comprises a cylindrical housing further comprising:

an aperture located at an upper location of said housing;

a gear support plate spanning across an upper portion of an interior of said cartridge enclosure;

an illumination suspension assembly support plate spanning across an upper portion of an interior of said cartridge housing subjacent from said gear support plate, further comprising a slot arranged in a spiral pattern;

a motor support plate spanning across a bottom portion of an interior of said cartridge enclosure;

a semi-rigid divider panel extending between a top surface of said motor support plate and a bottom surface of said illumination suspension assembly support plate, said divider panel arranged in a spiral pattern adjacent to said slot;

a support channel located inwardly from an inner surface opposite said aperture; and, a track connector located on an outer surface of said cartridge housing on opposing sides of said aperture;

wherein said illumination suspension assembly support plate is arranged in a spiral pattern, thereby providing a compact storage for said illumination suspension assembly within said cartridge housing in a vertically suspended position;

wherein said support channel provides a guide for said illumination suspension assembly traveling from said deploying means outward through said aperture; and, wherein said divider plate separates wrappings of said illumination suspension assembly, thereby preventing entanglement thereof.

14. The apparatus of claim 13, wherein said cartridge mounting means is at least one integral mounting hook extending outwardly from said cartridge housing removably attached to a receiving mount.

15. The apparatus of claim 13, wherein said track section further comprises:

an elongated track body comprising a semi-rigid compliant material and having a generally "T"-shaped inner channel and a mounting plate for receiving said track mounting means; and, an adapter piece providing a removable connection between said track section and said cartridge assembly, said adapter piece comprising a first end having a profile corresponding to an outer surface of said cartridge housing and removably connected to said track connector and a second end removably attached to said first end of said track portion;

wherein said illumination suspension assembly travels within said inner channel; and, wherein said track connector provides an aligned entrance and egress means of said illumination assembly.

16. The apparatus of claim 15, wherein said illumination suspension body further comprises:

an elongated "T"-shaped member having a first end affixed to said cartridge housing and a second end, comprising a drive member and a plurality of equidistantly-spaced downwardly depending illumination holders;

at least one pin-type male connection extending outward from said illumination body second end;

wherein said drive member further comprises a resilient and flexible construction;

wherein said illumination holders is adapted to retain a light string;

wherein said drive member is mechanically advanced by said deploying means; and, wherein said drive member is captured within said track channel.

17. The apparatus of claim 16, further comprising at least one extension illumination suspension assembly, each further comprising:

an extension illumination suspension body comprising elongated "T"-shaped member having a first end affixed to said cartridge housing and a second end, comprising an extension drive member and a plurality of equidistantly-spaced downwardly depending illumination holders;

at least one pin-type male connection extending outward from said extension illumination body second end; and, at least one female connection located on said extension illumination suspension body first end;

wherein said extension drive member body further comprises a resilient and flexible construction;

wherein said extension drive member is mechanically advanced by said deploying means when attached to said drive member;

wherein said extension drive member is captured within said track channel; and, wherein said at least one female connection is removably attached to an adjacent illumination body male connection or extension male connection.

18. The apparatus of claim 17, further comprising an end cap, comprising a pair of receiving apertures along a first end thereof.

19. The apparatus of claim 15, wherein said deploying means further comprises:

a reversible motor mounted onto said motor support plate and in electrical communication with said control means;

a drive shaft extending vertically through said motor support plate, said illumination assembly suspension support plate, and said gear support plate and terminating at a distal end;

a first gear in mechanical communication with said drive shaft and operably controlled thereby;

a second gear in mechanical communication with said first gear and operably controlled thereby;

a gear shaft in mechanical communication with said second gear and operably controlled thereby, said gear shaft extending vertically downward through said gear support plate and supported on said illumination suspension assembly support plate;

a reduction gear in mechanical communication with said gear shaft and operably controlled thereby; and, an idler gear supported on said illumination suspension assembly support plate positioned opposite said reduction gear;

wherein said motor is operable controlled by said control means;

wherein said motor drives said drive shaft, said first gear, said second gear, said gear shaft, and said reduction gear; and, wherein said reduction gear drives said drive member of said illumination suspension assembly towards said support channel and said idler gear assist in guiding said drive member.

20. The apparatus of claim 19, wherein said control means further comprises:

a control box mounted to said motor support plate and in electrical communication with said motor;

a power supply cord in electrical communication with said control box, said power supply cord routed through a wall of said cartridge housing;

a pair of magnetic strips, each affixed at an upper surface adjacent to said first end and said second end of said illumination suspension body;

a proximity sensor mounted to a bottom surface of said gear support plate along a centerline between said reduction gear and said idler gear, said proximity sensor in electrical communication with said control box;

wherein said control box supplies control to said deploying means;

wherein said control box is in wireless communication with said remote control;

wherein said proximity sensor generates and transmits a stop signal to said control box for ceasing motion of said motor upon sensing either one of said magnetic strip.

* * * * *